US009108240B2

(12) United States Patent
Yoo

(10) Patent No.: US 9,108,240 B2
(45) Date of Patent: Aug. 18, 2015

(54) METHOD OF MANUFACTURING CONTAINER FOR ABSORBING FLUID SHOCK OR MECHANICAL SHOCK

(76) Inventor: Tae-Seung Yoo, Bucheon-si (KR)

( * ) Notice: Subject to any disclaimer, the term of this patent is extended or adjusted under 35 U.S.C. 154(b) by 560 days.

(21) Appl. No.: 12/584,530

(22) Filed: Sep. 8, 2009

(65) Prior Publication Data

US 2010/0058826 A1 Mar. 11, 2010

(30) Foreign Application Priority Data

| | | |
|---|---|---|
| Sep. 9, 2008 | (KR) | 10-2008-0088999 |
| Sep. 9, 2008 | (KR) | 10-2008-0089000 |
| Oct. 24, 2008 | (KR) | 10-2008-0104863 |
| Oct. 24, 2008 | (KR) | 10-2008-0104864 |

(51) Int. Cl.
*B21D 51/16* (2006.01)
*B21D 41/04* (2006.01)

(52) U.S. Cl.
CPC ..... *B21D 51/16* (2013.01); *B21D 41/04* (2013.01)

(58) Field of Classification Search
CPC ..... B21D 51/16; B21D 41/04
USPC ..... 72/54, 27, 58, 60–62, 367.1, 368, 72/370.01, 370.02, 370.04, 370.06, 72/370.22, 370.1, 370.12, 370.13
See application file for complete search history.

(56) References Cited

U.S. PATENT DOCUMENTS

| | | | | |
|---|---|---|---|---|
| 2,679,681 | A * | 6/1954 | Resler | 72/324 |
| 3,977,227 | A * | 8/1976 | Noble | 72/253.1 |
| 5,903,964 | A * | 5/1999 | Uematsu et al. | 29/456 |
| 6,014,879 | A * | 1/2000 | Jaekel et al. | 72/61 |
| 7,380,429 | B1 * | 6/2008 | Ghiran et al. | 72/58 |
| 2008/0110222 | A1 * | 5/2008 | Ingvarsson | 72/55 |

FOREIGN PATENT DOCUMENTS

| | | |
|---|---|---|
| KR | 311465 | 9/2001 |
| KR | 412859 | 12/2003 |
| KR | 2008-10849 | 1/2008 |

* cited by examiner

*Primary Examiner* — Shelley Self
*Assistant Examiner* — Matthew G Katcoff
(74) *Attorney, Agent, or Firm* — Novick, Kim & Lee, PLLC; Jae Youn Kim

(57) ABSTRACT

Disclosed herein is a method of manufacturing a container for absorbing fluid shock or mechanical shock. The method includes preparing a raw material pipe, forming a coupling pipe by reducing a diameter of at least one side of the raw material pipe, and forming an inner circumference of the coupling pipe and bending it. Accordingly, a container body and a coupling pipe coupled to at least one side of the container body are integrated together, so that an additional process for coupling the container body with the coupling pipe is not required, and thus the cost of production is reduced.

3 Claims, 10 Drawing Sheets

METHOD OF MANUFACTURING CONTAINER FOR ABSORBING FLUID SHOCK OR MECHANICAL SHOCK

BACKGROUND OF THE INVENTION

1. Field of the Invention

The present invention relates to a method of manufacturing a container for absorbing fluid shock or mechanical shock, in which a container body having an enlarged diameter and a coupling pipe coupled to at least one side of the container body are manufactured through an outer-circumference reducing process and an inner-circumference cutting process, so that a process for coupling the container body with the coupling pipe can be eliminated, thus reducing manufacturing costs.

2. Description of the Related Art

Generally, a compressor of an air conditioner is driven by an engine. The compressor functions to compress low-pressure gas refrigerant fed from an evaporator and thereafter feed high-pressure refrigerant to a condenser.

The A/C compressor 1 is disclosed in Korean Patent No. 412859. As shown in FIG. 1A, the compressor 1 is connected to an air-conditioner unit (not shown) installed in a room via a refrigerant feeding means 3 which passes through a dash panel 2.

Here, the refrigerant feeding means 3 includes a coupling pipe 13 which is coupled to the A/C compressor 1, a coupling hose 23 which is coupled to the coupling pipe 13, and an air-conditioner unit pipe 33 which is coupled to the coupling hose 23 and passes through the dash panel 2 to be coupled to the air-conditioner unit installed in the room.

Further, a container 50 is provided at a predetermined position on the coupling pipe 13. Both sides of the container 50 are coupled to first and second coupling pipes 130 and 230. The container 50 functions to eliminate the noise of the refrigerant which flows through the refrigerant feeding means 3.

The coupling pipe 13 is coupled to the container 50 as follows. That is, as shown in FIG. 1B, when the container 50 is placed at a predetermined position on the coupling pipe 13, the first coupling pipe 130 coupled to the A/C compressor 1 is joined to an inlet flange 51 of the container 50 through welding, and the second coupling pipe 230 coupled to the coupling hose 23 is joined to an outlet flange 53 of the container 50 through welding.

Further, the container having the above-mentioned shape is applicable to an accumulator 5 for a refrigerator which is disclosed in Korean Patent No. 311465. As shown in FIG. 2, an inlet which is formed on the lower end of an accumulator body 5*a* to allow a refrigerant to enter the accumulator body 5*a* is formed vertically, and an outlet which is formed on the upper end of the accumulator body 5*a* to allow the refrigerant to be discharged from the accumulator body 5*a* is formed to be inclined relative to the inlet at a predetermined angle, thus preventing the refrigerant from flowing backwards, increasing the recovery rate of hydraulic fluid and preventing the generation of noise.

However, the container or the accumulator is coupled to the refrigerant feeding means 3 or is coupled between a compressor and an evaporator of the refrigerator through the first and second coupling pipes 130 and 230 which are provided on both sides of the coupling pipe 13. Thus, when the container or the accumulator is manufactured, a plurality of welding processes and washing operations are required, so that manufacturing costs are increased.

Further, a container manufacturing method is disclosed in Korean Patent Laid-Open Publication No. 2008-10849 dealing with the manufacture of the container. As shown in FIG. 3, the method includes an upper end forming step of reducing the diameter of the upper end of a circular hollow pipe manufactured through press extrusion, a lower end forming step of reducing the diameter of the lower end of the circular hollow pipe, and an end cutting and trimming step of cutting a pipe inlet and outlet of the circular hollow pipe which has gone through the upper and lower end forming steps to desired lengths, drilling the pipe so as to remove a burr, and rounding an end of the pipe.

However, the container manufacturing method reduces the diameter of the pipe as a result of the forming process, so that a difference in pipe thickness occurs when the first and second coupling pipes are coupled to the container, thus reducing the flow of the refrigerant. Further, noise is generated due to a difference in pressure, so that the reliability of the container is deteriorated.

SUMMARY OF THE INVENTION

Accordingly, the present invention has been made keeping in mind the above problems occurring in the prior art, and an object of the present invention is to provide a method of manufacturing a container for absorbing fluid shock or mechanical shock, which reduces manufacturing costs and material costs, and besides, reduces a weight, and is constructed so that a container body and a coupling pipe coupled to at least one side of the container body are integrated into a single structure, thus simplifying the process of coupling the container body with the coupling pipe, preventing the generation of noise and reduction in flow due to a projection at a junction of a compressor and the coupling pipe, and allowing the external appearance thereof to be smoother and more uniform, thus imparting an improved external appearance.

In order to accomplish the above object, the present invention provides a method of manufacturing a container for absorbing fluid shock or mechanical shock, including preparing a raw material pipe, preparing a die simultaneously forming a container body and a coupling pipe by repeatedly pushing the raw material pipe into the die and having an inner circumference forming part to form an inner circumference of the coupling pipe, forming the coupling pipe on at least one side of the container body by inserting the raw material pipe into the die and repeatedly pushing the raw material pipe to reduce an outer diameter of at least one side of the raw material pipe; and moving the inner circumference forming part to form an inner circumference of the coupling pipe.

Further, in order to accomplish the above object, the present invention provides a method of manufacturing a container for absorbing fluid shock or mechanical shock, including preparing a pipe having a diameter which is smaller than that of a desired container body, inserting the pipe into a die having an outer circumference forming part of a desired diameter, and enlarging the diameter of the pipe using pressure of fluid supplied to an inner circumference of the pipe, thus preparing a raw material pipe, inserting the raw material pipe into a die constructed so that a tapered surface and a pipe manufacturing part are continuously formed, and repeatedly pressing the raw material pipe to reduce an outer diameter of at least one side of the raw material pipe, thus forming a coupling pipe which extends integrally from at least one side of the container body, and cutting an inner circumference of the coupling pipe.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, the preferred embodiments of the present invention will be described in detail.

Figure 1A:
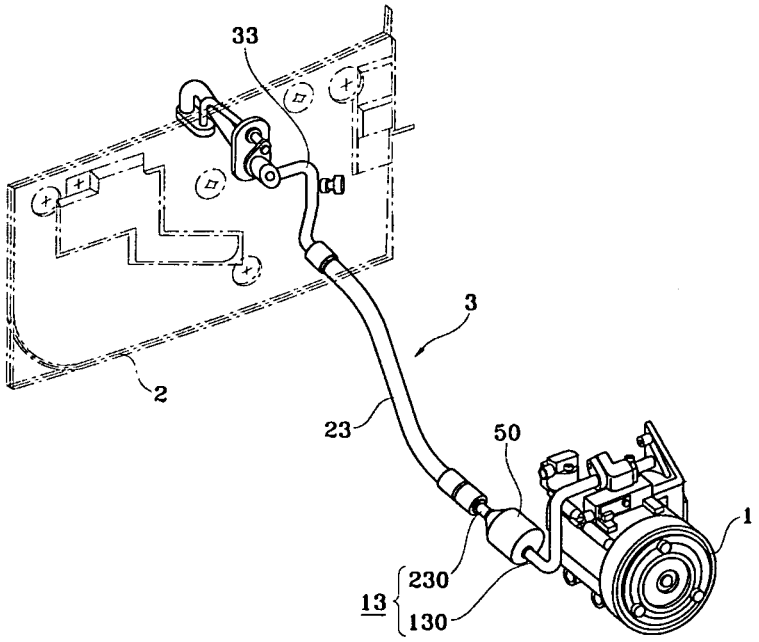
Fig. 1A Prior Art
FIGS. 1A and 1B are a perspective view and a sectional view, respectively, illustrating the conventional coupled state of an A/C compressor with a container.
Figure 1B:
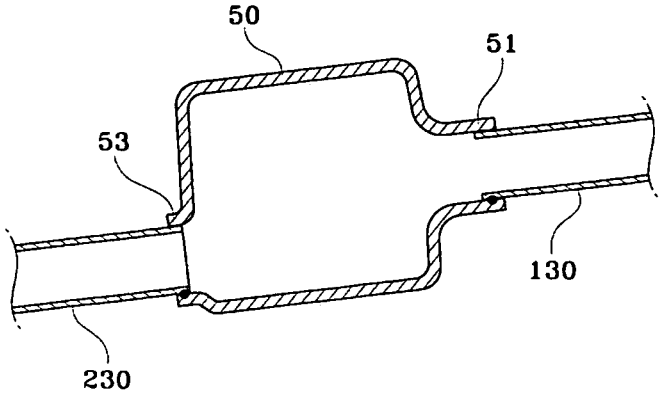
Fig. 1B Prior Art
Figure 2:
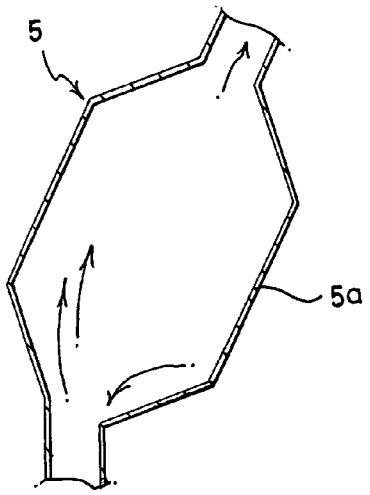
Fig. 2 Prior Art
FIG. 2 is a sectional view illustrating a conventional accumulator for a refrigerator.
Figure 3:
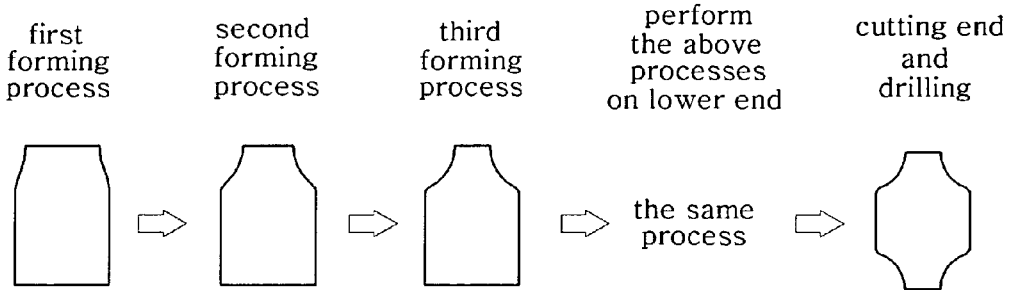
Fig. 3 Prior Art
FIG. 3 is a flowchart illustrating a conventional container manufacturing method.
Figure 4:
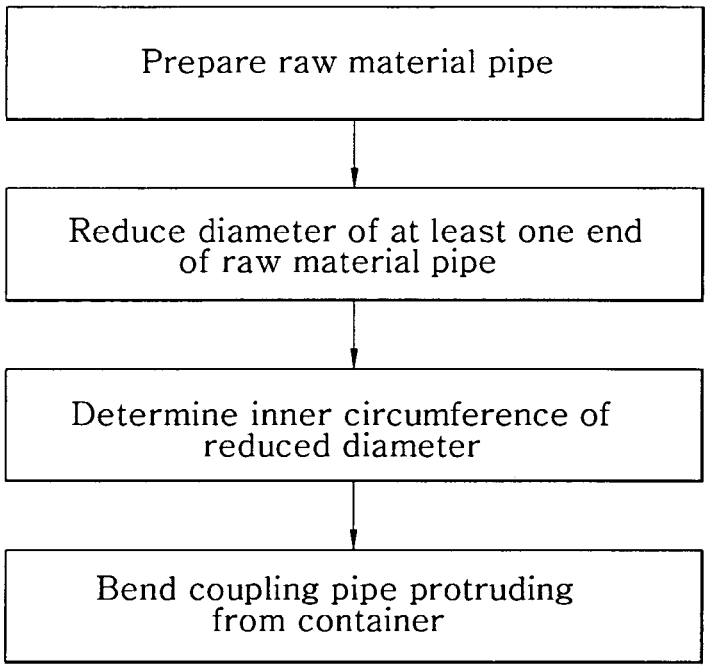
FIG. 4 is a flowchart illustrating a container manufacturing method according to a first embodiment of the present invention.
Figure 5:
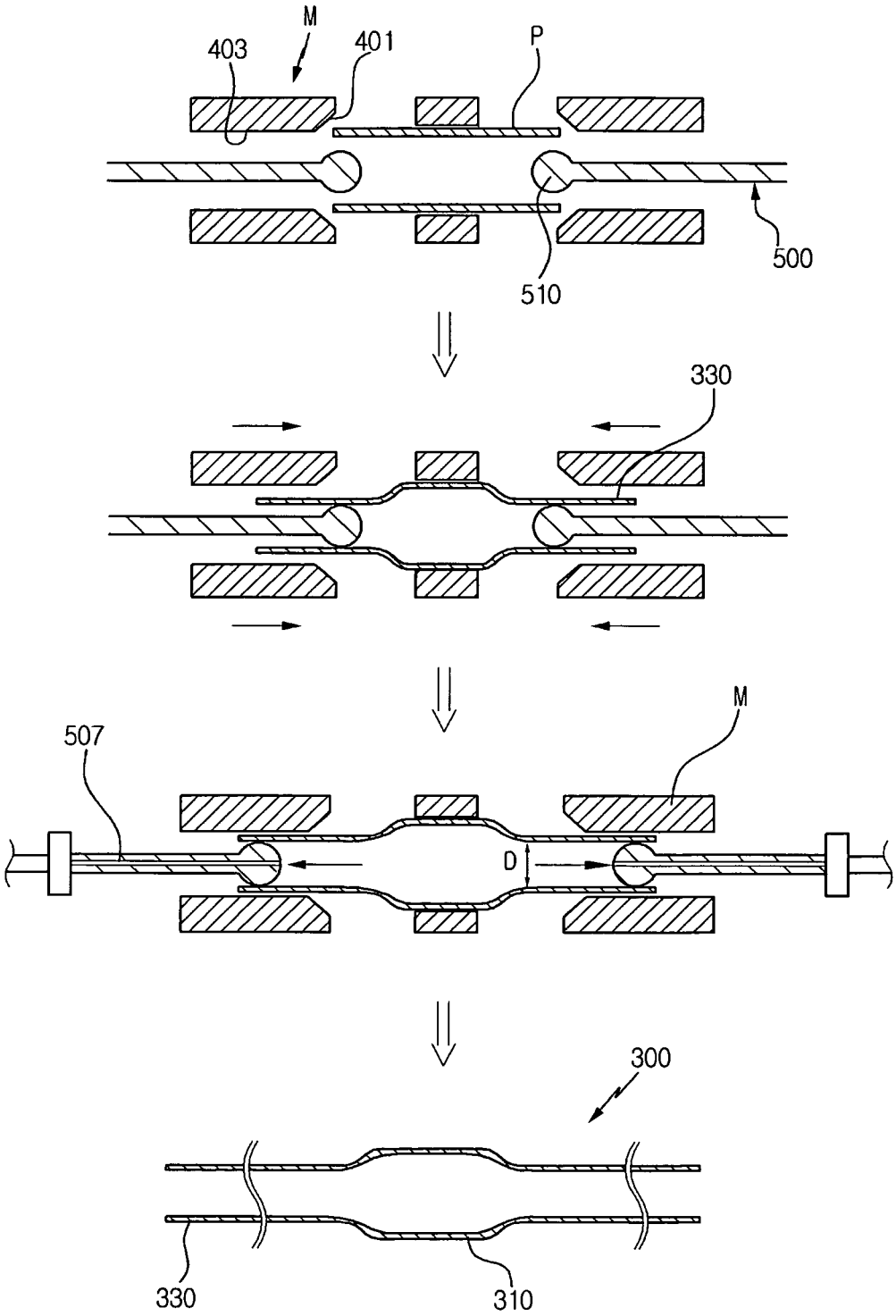
FIG. 5 is a view illustrating the container manufacturing process according to the first embodiment of the present invention.
Figure 6A:
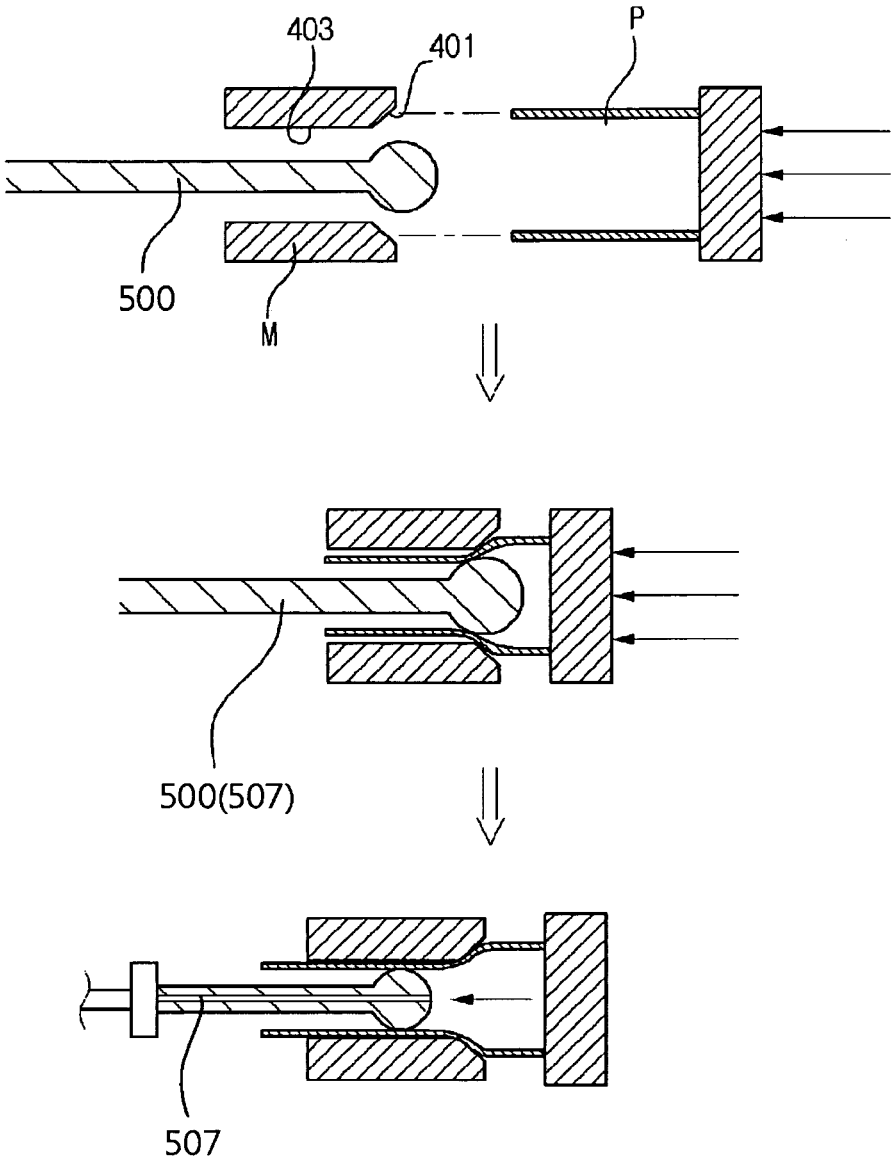
FIGS. 6A and 6B are views illustrating a container manufacturing process according to a modification of FIG. 5.
Figure 6B:
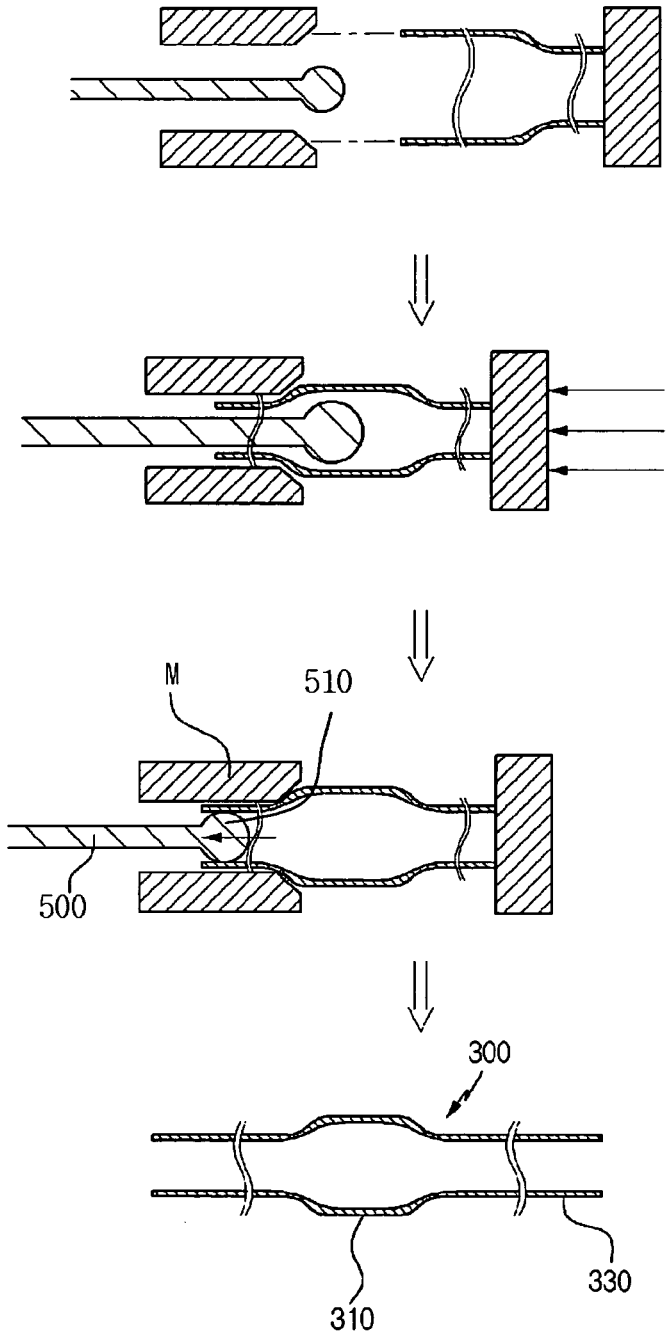
Figure 7:
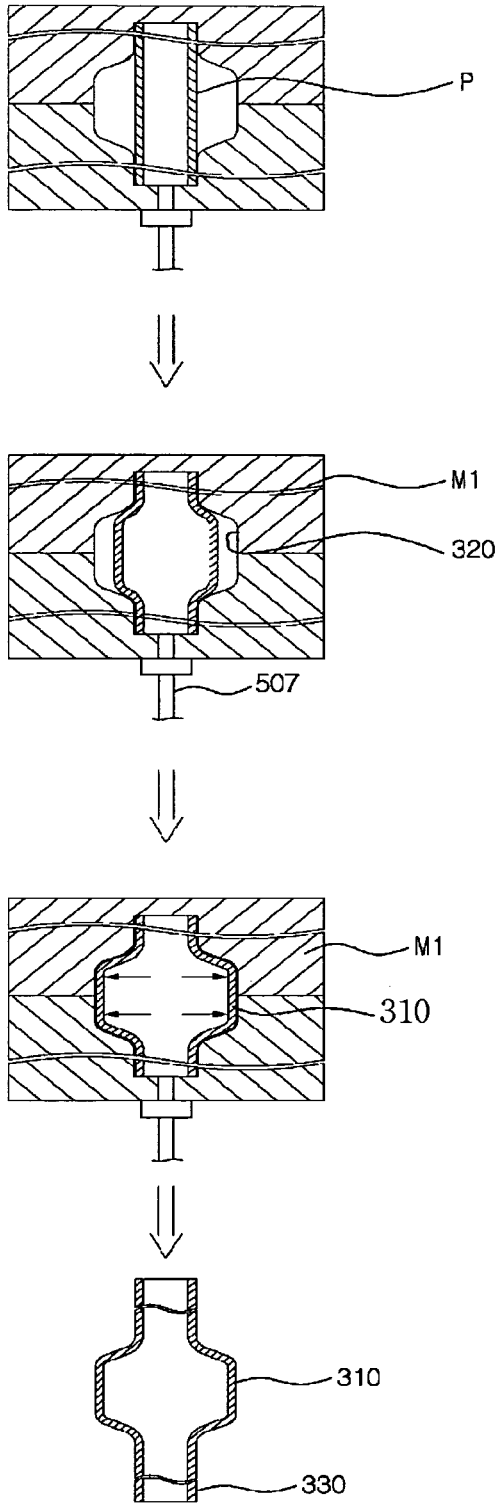
FIGS. 7 and 8 are views illustrating container manufacturing processes according to other modifications of FIG. 5.
Figure 8:
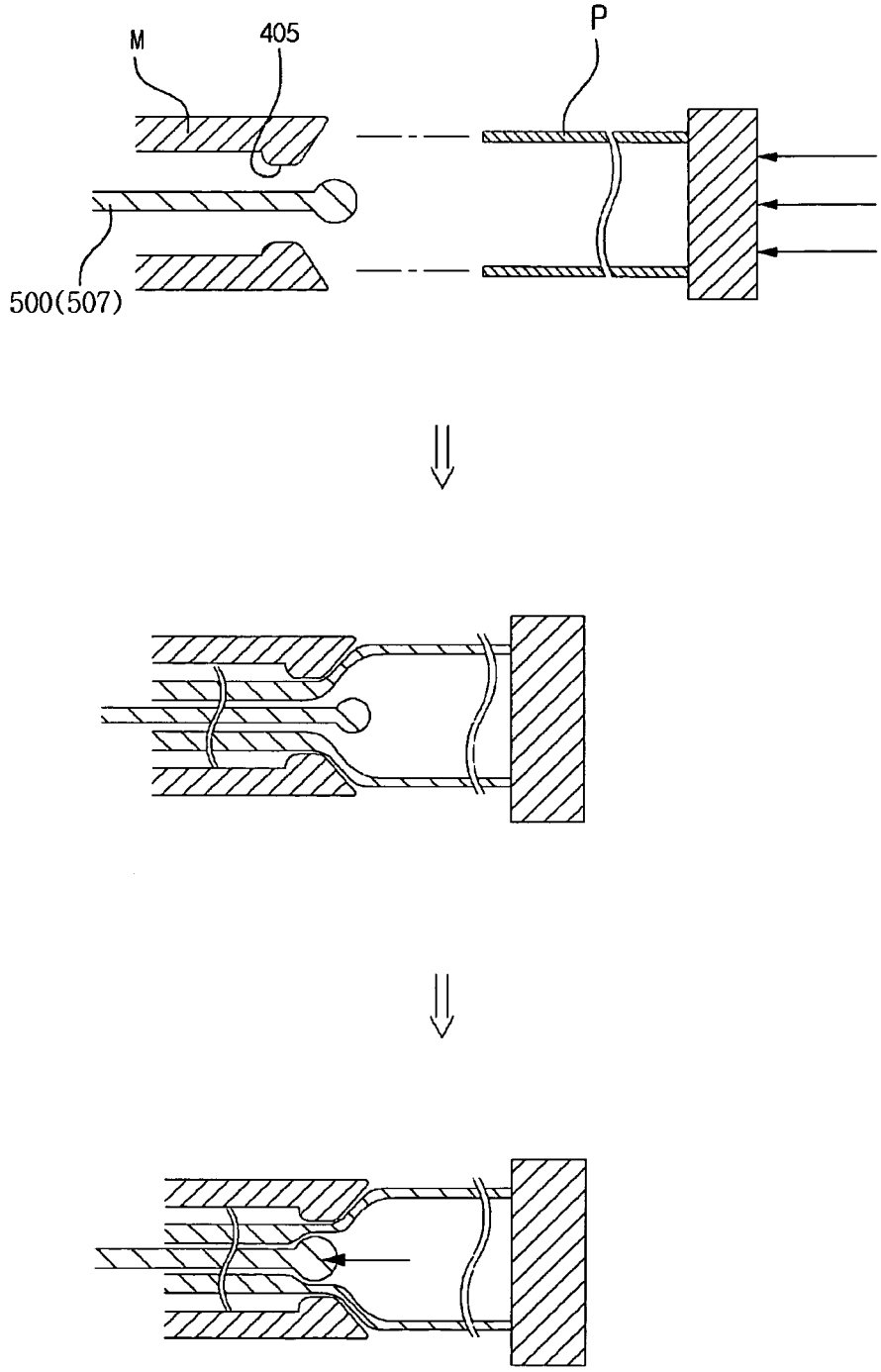

FIG. 4 is a flowchart illustrating a container manufacturing method according to a first embodiment of the present invention, FIG. 5 is a view illustrating the container manufacturing process according to the first embodiment of the present invention, FIGS. 6A and 6B are views illustrating a container manufacturing process according to a modification of FIG. 5, and FIGS. 7 and 8 are views illustrating container manufacturing processes according to other modifications of FIG. 5.

A container 300 of the present invention is constructed so that a container body 310 having an enlarged diameter and a coupling pipe 330 coupled to at least one side of the container body 310 are integrated into a single structure.

Further, the container 300 of the present invention is used for an accumulator for a refrigerator or a muffler for a vehicle, but is not limited thereto.

The method of manufacturing the container 300 of the present invention will be described below.

In the first step, a raw material pipe P of a predetermined length which has an outer diameter corresponding to the outer diameter of the container 300 is prepared. The diameter of the raw material pipe P may be equal to or smaller than that of the container body 310. Most preferably, the raw material pipe P and the container body 310 have the same diameter, because it is advantageous to reduce the number of processes.

According to a modification, a pipe having an outer diameter which is smaller than that of the container 300 may be prepared as the raw material pipe P. In this case, the raw material pipe is inserted into a subsidiary die M1 having an outer circumference forming part 320 for forming the pipe such that it has a desired outer diameter. Next, a hydraulic-pressure supply pipe 507 is inserted into the inner circumference of the pipe P and expands the pipe P using the pressure of fluid supplied through the hydraulic-pressure supply pipe 507 so that the pipe P has a desired outer diameter (see FIG. 7).

In the second step, an end of the raw material pipe P is pushed into a die M having a pipe manufacturing part 403 which extends from a tapered surface 401 by a predetermined length, so that the diameters D of both sides of the raw material pipe P are reduced.

In the third step, a process of determining the inner circumference of both ends of the reduced raw material pipe P is performed, so that the coupling pipe 330 is an integral extension of the container body 310 in the coaxial direction of the container body 310.

Here, an inner circumference forming part 500, which has on an end thereof a compressing part 510 to form the inner circumference of the container 300, is movably provided in the die M.

Meanwhile, the pipe manufacturing part 403 is provided in the die M in such a way as to extend from the tapered surface 401.

Preferably, the hydraulic-pressure supply pipe 507 is further provided in an end of the inner circumference forming part 500 to supply hydraulic pressure to the raw material pipe P.

In the fourth step, the coupling pipe 330 which is to be coupled to a compressor is integrally formed on at least one side of the raw material pipe P through the die M and then is bent in a desired direction, so that the container 300 is finished.

According to another modification of the present invention, a round part 405 protrudes from a predetermined portion of the tapered surface 401 to correspond to the inner circumference forming part 500 and extends from the tapered surface 401 (see FIG. 8).

The manufacturing method of the present invention will be described below in detail based on the above-mentioned basic steps.

As shown in FIGS. 4 to 8, the container 300 of the present invention is constructed so that the container body 310 having an enlarged diameter and the coupling pipe 330 coupled to at least one side of the container body 310 are integrated into a single structure, thus solving the problems which may occur in the conventional method of additionally coupling the coupling pipe to the container body 310 through welding.

In the container 300 of this invention, in order to integrally form the container body 310 and the coupling pipe 330 protruding from at least one side of the container body 310, the raw material pipe P of a predetermined length having an outer diameter similar to that of the container 300 is prepared.

Of course, the raw material pipe P may be made using a pipe which has an outer diameter smaller than that of the container 300. In this case, the process of FIG. 7 must be additionally performed. That is, when the container 300 is manufactured using the pipe having an outer diameter which as described above is smaller than that of the container desired to be formed, the raw material pipe P is inserted into the subsidiary die M1 having the outer circumference forming part 320 which corresponds to a desired diameter. Afterwards, pressure is supplied into the raw material pipe P through the hydraulic-pressure supply pipe 507, so that the raw material pipe P becomes enlarged to the desired diameter.

According to a further modification, in the pipe expanding operation, the hydraulic-pressure supply pipe 507 is installed in the inner circumference forming part 500 which will be described below, so that the operation of forming the inner circumference and the operation of expanding the pipe P may be performed simultaneously. This may be conducted by combining the methods of FIGS. 7 and 8.

Further, as described above, the raw material pipe P having the same outer diameter as the container body 310 is prepared. The raw material pipe P is mounted to the die M which has the tapered surface 401 and the pipe manufacturing part 403 to correspond to the container body 310 and the coupling pipe 330 of the container 300.

Here, the inner circumference forming part 500 which has on an end thereof the ball-shaped compressing part 510 which is for forming the inner circumference of the container 300 is previously prepared in the die M.

Subsequently, according to the present invention, the die M is repeatedly pushed to reduce the diameter D. The operation of reducing the diameter D of the pipe may be performed by one die, or may be performed by dies whose diameters are reduced in gradations.

Next, when the diameter of at least one side of the raw material pipe P is reduced, the inner circumference forming part 500 provided in the die M is pulled outwards. As such, since the inner circumference forming part 500 forms a desired inner circumference while expanding the inner circumference of the raw material pipe P, the container integrally having the container body 310 and the coupling pipe 330 can be obtained in the form of a finished product.

If the outer diameter of the raw material pipe P is slightly smaller than that of the desired container body 310, the outer diameter of the raw material pipe P is reduced at both sides thereof by the die M, and then the inner circumference forming part 500 is moved to be in close contact with the inner circumference of the raw material pipe P. Thereafter, pressure is supplied into the raw material pipe P through the hydraulic-pressure supply pipe 507, so that the raw material pipe P is enlarged to a desired diameter.

Meanwhile, the diameter reducing operation for manufacturing the coupling pipe 330 may be performed simultaneously at both sides of the raw material pipe P as shown in FIG. 5. Alternatively, as shown in FIGS. 6A and 6B, after the diameter of one side of the pipe P has been reduced, the diameter of the other side of the pipe P may be reduced.

The raw material pipe P is formed using the above die such that the container body 310 and the coupling pipe 330 are integrated with each other. Thereafter, the coupling pipe 330 is bent in a desired direction. In this way, the container 300 which is easily coupled to an A/C compressor or a compressor for the refrigerator is completed without having to perform an additional welding operation.

Meanwhile, the die M is provided with the round part 405 which protrudes from a side of the tapered surface 401 to correspond to the inner circumference forming part 500 and extends from the tapered surface 401, so that the inner circumference forming part 500 and the die M move simultaneously relative to the raw material pipe P, thus forming the inner circumference of the coupling pipe 330. That is, as if the raw material pipe P were drawn, the thickness of the raw material pipe P is reduced by the round part 405 and the inner circumference forming part 500, so that the coupling pipe 330 of a desired dimension is completed.

Figure 9:
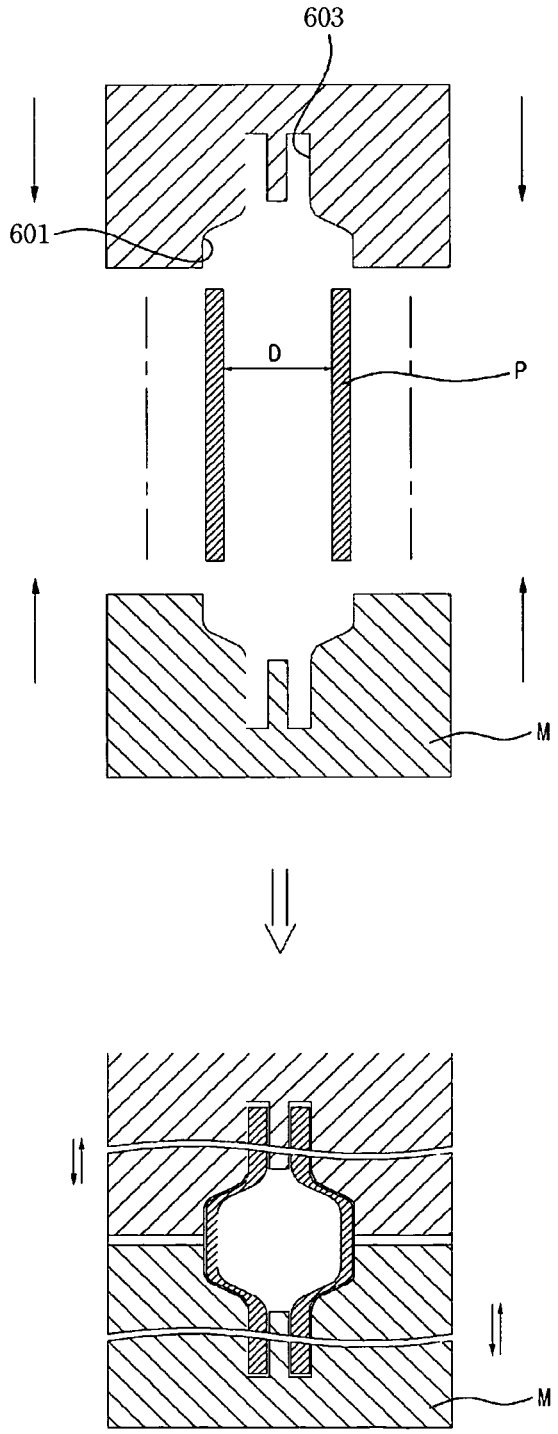
FIG. 9 is a flowchart illustrating a container manufacturing method according to a second embodiment of the present invention.
Figure 10:
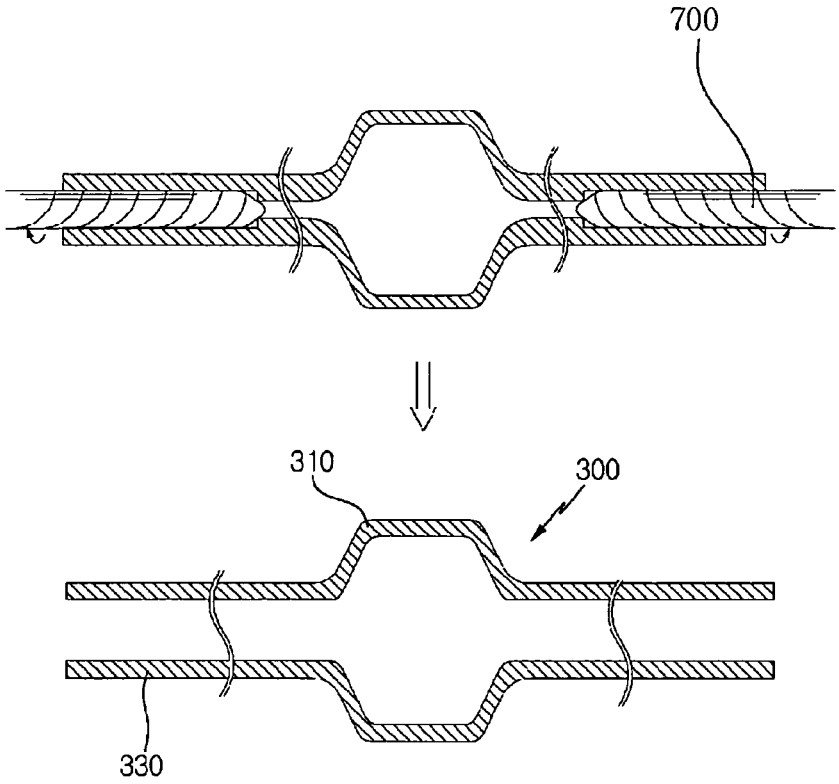
FIG. 10 is a view illustrating a process subsequent to the container manufacturing process of FIG. 9.

FIG. 9 is a flowchart illustrating a container manufacturing method according to a second embodiment of the present invention, and FIG. 10 is a view illustrating a process subsequent to the container manufacturing process of FIG. 9.

A container 300 of the present invention is constructed so that a container body 310 having an enlarged diameter and a coupling pipe 330 coupled to at least one side of the container body 310 are integrated into a single structure.

Further, the container 300 of the present invention is used as the container of an accumulator which is provided between a compressor and an evaporator of a refrigerator, or as the container of a muffler of an A/C compressor for a car.

In the manufacturing method according to the second embodiment of the present invention, in the first step, a raw material pipe P having a predetermined length and an outer diameter which is almost equal to the outer diameter of the container 300 is prepared.

Of course, in the preparation step of the raw material pipe P, as shown in FIG. 7, a pipe having an outer diameter smaller than that of the container 300 may be prepared. In this case, the raw material pipe P is placed in the die M1 having the outer circumference forming part 320 corresponding to a desired outer circumference of a pipe and a hydraulic-pressure supply pipe 507 supplies pressure into the raw material pipe P, so that the pipe is expanded to have the same outer diameter as the container 300.

In the second step, an end of the raw material pipe P is pushed into a die M which is constructed so that a pipe manufacturing part 603 of a predetermined length extends from a side of a tapered surface 601, thus reducing the diameter D of the pipe P.

Finally, in the third step, the pipe having the diameter D reduced as described above is cut to have a desired inner circumference using a cutting tool 700, so that the coupling pipe is completed.

The manufacturing method according to the second embodiment of the present invention having the above-mentioned steps will be described below in detail.

As shown in FIGS. 9 and 10, the container 300 of the present invention is constructed so that the coupling pipe 330 is provided coaxially on both ends of the container body 310 to be integrated with the container body 310, thus solving the problem of the conventional container. That is, it is unnecessary to additionally couple the coupling pipe 330 to the container body 310.

In the first step, in order to form the container 300 integrally having the container body 310 and the coupling pipe 330, the raw material pipe P having a predetermined length and an outer diameter which is very similar to that of the container 300 is prepared.

Of course, the raw material pipe P may have an outer diameter which is smaller than that of the container 300, as in the first embodiment. In this case, after the raw material pipe P is inserted into the subsidiary die M1 having the outer circumference forming part 320 corresponding to a desired diameter, pressure is supplied into the raw material pipe P through the hydraulic-pressure supply pipe 507, so that the raw material pipe P is enlarged to a desired diameter.

In the second step, when the raw material pipe P is inserted into the die M which is constructed so that the pipe manufacturing part 603 of a predetermined length extends from a side of the tapered surface 601 and then is repeatedly pressed, the container 300 having an integrated container body 310 and coupling pipe 330 can be obtained.

Here, in a semi-finished product which is undergoing the process of integrally forming the container body 310 and the coupling pipe 330 using the die M, the inner diameter of the coupling pipe 330 may become much smaller than a desired diameter because of the contraction operation of the die M.

In the final third step, when the inner circumference reduced as described above is cut using the cutting tool 700, the coupling pipe 330 having a desired inner diameter results. Thereby, a finial container 300 is completed.

By bending the coupling pipe 330 of the container 300, which is formed such that the container body 310 and the coupling pipe 330 are integrated into a single structure, in a desired direction, the container 300 may be immediately coupled to an A/C compressor or like.

As described above, the present invention provides a method of manufacturing a container for absorbing fluid shock or mechanical shock, which reduces manufacturing costs and material costs, and besides, is reduced in weight owing to the elimination of a welded part, and is constructed so that a container body and a coupling pipe coupled to at least one side of the container body are integrated into a single structure, thus simplifying the process of coupling the container body with the coupling pipe, preventing the generation of noise and reduction in flow due to a projection at a junction of a compressor and another pipe because the coupling of pipes is unnecessary, and allowing the external appearance thereof to be smoother and more uniform, thus imparting an improved external appearance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing a pipe having a reduced end portion, said method comprising the steps of:

(a) providing a pipe;

(b) providing a die set, wherein the die set includes a reducing die having a through hole and a drawing rod inserted into the through hole and coaxially aligned with the through hole, wherein the inner diameter of the through hole of the reducing die is smaller than the outer diameter of the pipe, wherein the drawing rod has an end portion, and wherein an end of the through hole of the reducing die has an enlarged portion and the end portion of the drawing rod is positioned in the enlarged portion;

(c) pushing the reducing die and the drawing rod forward against an end portion of the pipe to a distance in order to reduce the outer diameter of the end portion of the pipe by the movement of the reducing die, thereby forming a preliminarily reduced end portion of the pipe, wherein the end portion of the drawing rod has a diameter larger than the inner diameter of the preliminarily reduced end portion of the pipe;

(d) pulling the drawing rod backward from the pipe in order to enlarge the inner diameter of the preliminarily reduced end portion of the pipe by the movement of the end portion of the drawing rod, thereby forming the reduced end portion of the pipe; and (e) pulling the reducing die backward from the pipe.

2. The method as set forth in claim 1, wherein the die set further includes a pipe support having another through hole to support the pipe by receiving the pipe center portion.

3. The method as set forth in claim 2, wherein the die set further includes a second reducing die having a through hole and a second drawing rod inserted into the through hole of the second reducing die, coaxially aligned with the through hole of the second reducing die, and disposed at the opposite end of the pipe, wherein the inner diameter of the through hole of the second reducing die is smaller than the outer diameter of the pipe, wherein the second drawing rod has an end portion, and wherein an end of the through hole of the second reducing die has an enlarged portion and the end portion of the second drawing rod is positioned in the enlarged portion of the second reducing die, the step (c) further comprising a step of pushing the second reducing die and the second drawing rod forward against the opposite end portion of the pipe to a distance in order to reduce the outer diameter of the opposite end portion of the pipe by the movement of the reducing die, thereby forming a second preliminarily reduced end portion of the pipe, wherein the end portion of the second drawing rod has a diameter larger than the inner diameter of the second preliminarily reduced end portion of the pipe;

the step (d) further comprising a step of pulling the second drawing rod backward from the pipe in order to enlarge the inner diameter of the opposite end portion of the pipe by the movement of the end portion of the second drawing rod, thereby forming the reduced end portion in the opposite end of the pipe; and the step (e) further comprising a step of pulling the second reducing die backward from the pipe.

* * * * *